United States Patent [19]

Hills

[11] 4,280,292

[45] Jul. 28, 1981

[54] TORSO-AND DISPLAY-SUPPORTABLE PUPPET

[75] Inventor: Isaac A. Hills, Brooklyn, N.Y.

[73] Assignee: Animal Toys Plus, Inc., Brooklyn, N.Y.

[21] Appl. No.: 177,920

[22] Filed: Aug. 14, 1980

[51] Int. Cl.[3] ..... G09F 1/08; A63H 3/14

[52] U.S. Cl. ..... 40/538; 46/154

[58] Field of Search ..... 46/154, 153, 126, 116; 40/539, 124.1, 538; 272/25, 8 R, 8 D; 223/72; 35/56

[56] References Cited

U.S. PATENT DOCUMENTS

| | | | |
|---|---|---|---|
| D. 59,011 | 9/1921 | Keller . | |
| D. 111,113 | 8/1938 | Valentine . | |
| D. 117,674 | 11/1939 | Lewis . | |
| D. 159,579 | 8/1950 | Berger . | |
| D. 160,584 | 10/1950 | Faustman . | |
| D. 166,051 | 2/1952 | Secter . | |
| D. 167,433 | 8/1952 | Van Laar . | |
| D. 182,140 | 2/1958 | Molke . | |
| D. 205,944 | 10/1966 | Mueller . | |
| D. 224,417 | 7/1972 | Houser . | |
| 293,324 | 2/1884 | Hanlon | 272/25 |
| 1,103,327 | 7/1914 | Thomson | 40/539 X |
| 1,267,567 | 5/1918 | Lundgren | 272/25 |
| 1,505,942 | 8/1924 | Blanton | 46/154 UX |
| 1,595,090 | 8/1926 | Hart | 40/539 |
| 1,826,939 | 10/1931 | Kohirogawa | 35/56 |
| 1,870,395 | 8/1932 | Zarin | 40/539 |
| 1,901,661 | 3/1933 | MacCourt et al. | 40/539 |
| 2,441,333 | 5/1948 | Reinsberg | 40/539 |
| 2,624,155 | 1/1953 | Boyce . | |
| 2,681,449 | 6/1954 | Montez | 272/25 |
| 2,725,670 | 12/1955 | Hodes | 46/116 |
| 2,795,896 | 6/1957 | Snyder . | |
| 2,929,170 | 3/1960 | Brown et al. . | |
| 3,308,479 | 3/1967 | Sesco | 46/154 X |
| 3,526,990 | 9/1970 | Edmonds | 46/116 |
| 4,197,604 | 4/1980 | Nakamura . | |
| 4,197,670 | 4/1980 | Cox . | |
| 4,206,568 | 6/1980 | Garner | 46/153 |

*Primary Examiner*—F. Barry Shay

*Attorney, Agent, or Firm*—Kirschstein, Kirschstein, Ottinger & Corbin

[57] ABSTRACT

A manipulatable toy puppet is supportable on a human torso and also on a display support in a manner which resembles the torso-supported puppet. The puppet's arms are detachably secured around the manipulator's neck by Velcro-type fasteners, and the puppet's legs are secured about the manipulator's waist by an adjustable elastic band. The puppet figure is made of a soft plush-covered material to simulate animal fur. The display support has a humanoid-like portion which resembles the upper part of a human, and an arm support portion which resembles the upraised human forearm. Hence, the body of the puppet can be supported on the arm support portion, and the puppet's arms and legs can be mounted on the display in a manner which simulates the hugging-type pose in which the puppet is supported on a human being.

13 Claims, 7 Drawing Figures

TORSO-AND DISPLAY-SUPPORTABLE PUPPET

BACKGROUND OF THE INVENTION

1. Field of the Invention

This invention generally relates to a toy puppet and, more particularly, to a puppet which is supportable either on a human torso for manipulative play action purposes, or on a humanoid-like display support for display purposes.

2. Description of the Prior Art

Small- and large-scale manipulatable puppets resembling an animal, person or like figure are well-known for their play value and entertainment appeal to all audiences, especially children. Such puppets include the full-bodied articulated puppets having jointed string-supported limbs which are separately manipulatable from above the puppet, as well as miniature finger puppets and hand puppets. The finger puppets are manipulated solely by the manipulator's fingers, whereas the hand puppets generally require the manipulator's entire hand. The manipulator may use all the fingers of his hand to move the puppet's mouth or, in some cases, the manipulator inserts at least one finger into the puppet head, and inserts his other fingers into the puppet's respective limbs to provide full-bodied puppet movement.

Although generally satisfactory for their intended play nd entertainment purposes, as well as for educational and physical coordination purposes, the finger- and hand-puppets of the prior art are miniature figures in the sense that they must generally conform to the size of the manipulator's fingers and/or hand. In order to provide a more life-sized puppet, it is desirable to increase the overall dimensions of the finger- and hand-puppets to a size which is larger than the average human hand. However, only the puppet head of such larger-sized puppets is directly supported by the manipulator's hand. The puppet arms and legs are typically left unsupported and unmanipulatable. Such dangling limbs impart a very unappealing and undesirable limp apperarance for the puppet. As a result, the limp puppet not only fails to create the impression of a realistic-looking large-scale puppet figure, but also fails to properly display the puppet in, for example, a commercial setting.

In order to increase the play, entertainment, educational and coordination value of a large-sized puppet, it is very desirable for the puppet to assume an embracing-, cuddling- and hugging-type posture with the person. To the best of my knowledge, no manipulative puppet exists in the prior art which is supportable on the manipulator's person, or which is positioned in a hugging-type posture during use.

SUMMARY OF THE INVENTION

1. Objects of the Invention

Accordingly, it is the general object of the present invention to overcome the above-mentioned drawbacks of the prior art.

Another object of the present invention is to provide a more realistic-looking, larger-sized puppet which is manipulatable by the manipulator's hand and arm, and which is supportable on the manipulator's torso during such manipulation.

Still another object of the present invention is to provide a manipulative puppet which assumes an embracing-, cuddling- and hugging-type posture with the manipulator's person.

Yet another object of the present invention is to provide a more realistic-acting toy puppet which is manipulatable by the manipulator's hand and arm in a manner such that the manipulator's hand and forearm are within the puppet and essentially hidden from view.

A further object of this invention is to provide a cute and lovable animal-like puppet whose arms cling around the manipulator's neck, whose legs grasp around the manipulator's waist, and whose face faces the manipulator's face.

Still a further object of this invention is to provide a toy puppet which is fully supportable on a display stand without having any of its limbs dangling freely.

Still another object of this invention is to provide a display-supportable puppet which simulates a human body-supportable puppet.

Yet another object of this invention is to provide a toy puppet which is supportable not only on a human torso, but also on a display.

Another object of this invention is to increase the play, educational and physical coordination value and entertainment appeal for all audiences, especially children.

Still another object of this invention is to provide an attractive toy puppet which can serve as an imaginary playmate for children.

2. Features of the Invention

In keeping with these objects and others which will become apparent hereinafter, one feature of the invention resides, briefly stated, in a toy puppet which is supportable not only on a human torso, but also on a display support. In a preferred embodiment, the toy puppet has a figure which resembles an animal-like figure. The puppet has a hollow puppet head, a hollow puppet body mounted on the puppet head, a pair of upper puppet limbs or arms extending from the upper part of the puppet body, and a pair of lower puppet limbs or legs extending from the lower part of the puppet body. The puppet figure is preferably made of a soft, plush cotton-like material which bounds an interior cavity that is located within the puppet head and body.

As noted above, the toy puppet is supportable on a manipulator's torso. In accordance with this invention, torso-supporting means are provided on the puppet figure for supporting the same on the manipulator's torso. The torso-supporting means includes neck-supporting means for securing the puppet arms around and behind the manipulator's neck region, and waist-supporting means for securing the puppet legs behind the manipulator's waist region. In a preferred embodiment, the neck-suppporting means constitutes a pair of quick connect-disconnect Velcro-type fasteners each mounted on an end region of the puppet arms, and preferably on the puppet hands. This permits the puppet arms to be detachably interconnected behind the manipulator's neck. As for the waist-supporting means, this constitutes an expandable member, such as an elastic rubber band, which is permanently connected between the end regions of the puppet legs, i.e. on the puppet feet. The elastic band completes the encirclement of the manipulator's waist. The elastic band expands or contracts, as needed, in order to accommodate to the differently-sized manipulators' waist regions.

Thus, the torso-supportable puppet has its puppet arms wrapped around the manipulator's neck, and its puppet legs wrapped at least about the major portion of the manipulator's waist. The manipulator thereupon freely inserts his hand, with clearance, into the hollow puppet head to manipulate the same, and freely inserts at least a major portion of his forearm, with clearance, into the hollow puppet body to manipulate the same. The manipulator's hand and forearm are located within the interior cavity and are effectively hidden from the view of the audience. This posture for the puppet can be described as embracing, cuddling and hugging the manipulator.

The aforesaid puppet posture greatly increases the play value and entertainment appeal for children, because it appears that the puppet is hugging the manipulator in a loving manner. Also, because more than just the hand is inserted into the interior cavity of the puppet, the puppet is of a larger size as compared to the finger- and hand-puppets of the prior art. This results in a more life-like appearance for the puppet. Further, even though the puppet arms and legs are not supported or directly manipulated by the manipulator's hand or forearm, the puppet's arms and legs are not left unsupported and dangling freely. Instead, the puppet's arms and legs are supported by the manipulator's torso.

In accordance with another feature of this invention, the top puppet described above is also supportable on a display support in a manner which resembles the above-described human torso-supported puppet. The display support comprises an upright humanoid-like portion which generally resembles the upper portion of a human, and an upright arm support portion which generally resembles the upraised human forearm. The upright arm support portion is located closely adjacent to, and spaced apart from, the humanoid-like portion. The humanoid-like portion includes a neck-like display portion and a waist-like display portion.

In order to support the puppet on the display support, the upright arm support portion is freely insertable, with clearance, into the interior cavity within the puppet head and body. Thereupon, the puppet arms are detachably secured behind the neck-like display portion, whereas the puppet legs are secured around the waist-like display portion.

The display-supported puppet again assumes a lovable hugging-type posture with the humanoid-like portion of the display support. This display posture simulates the pose in which the puppet is supported on the human manipulator. The puppet's arms and legs are not left dangling freely, but are supported at all times. Hence, the display-supportable puppet makes a very attractive and attention-getting display to attract consumers.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
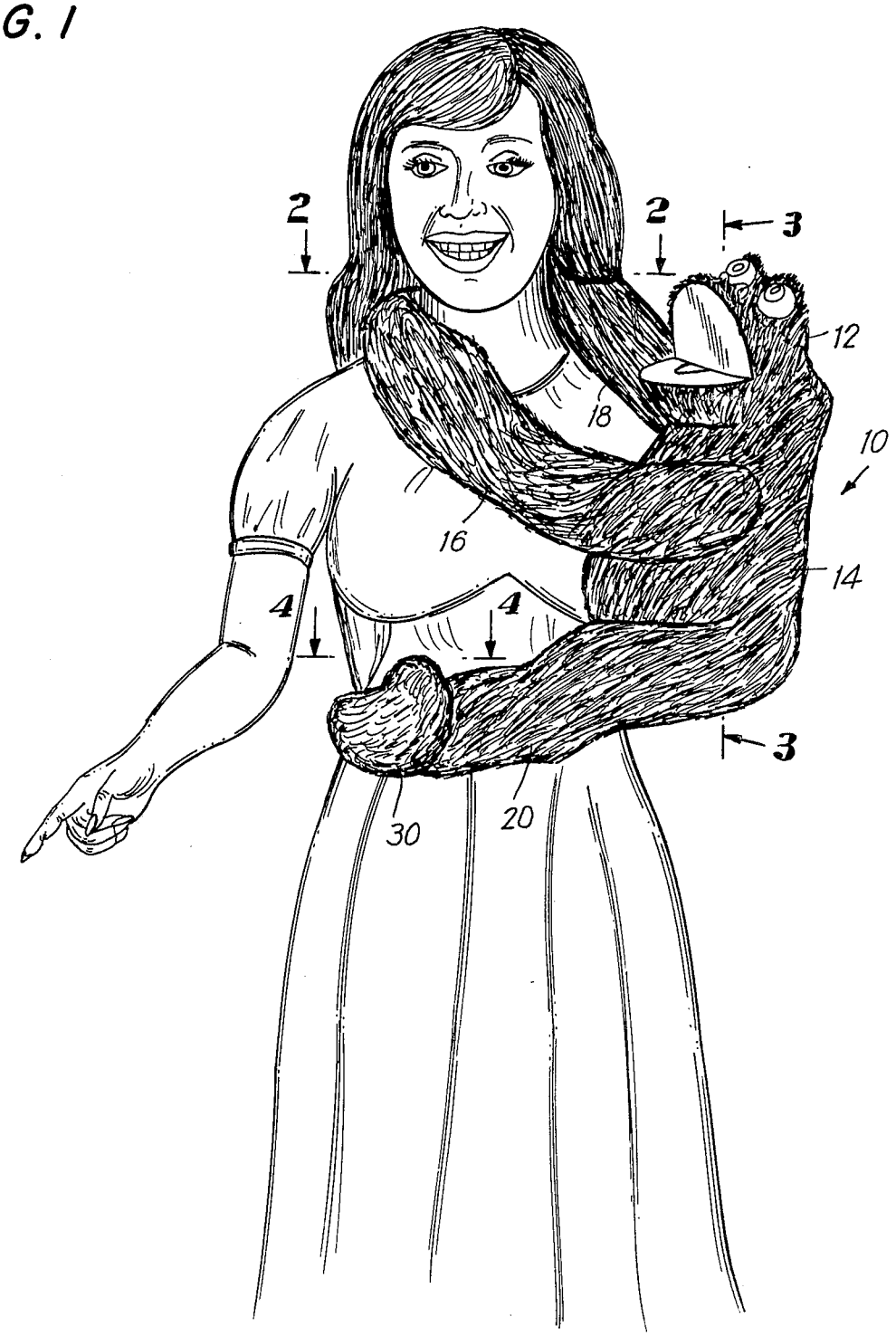
FIG. 1 is a toy puppet supported on a manipulator's torso in accordance with this invention.
Figure 5:
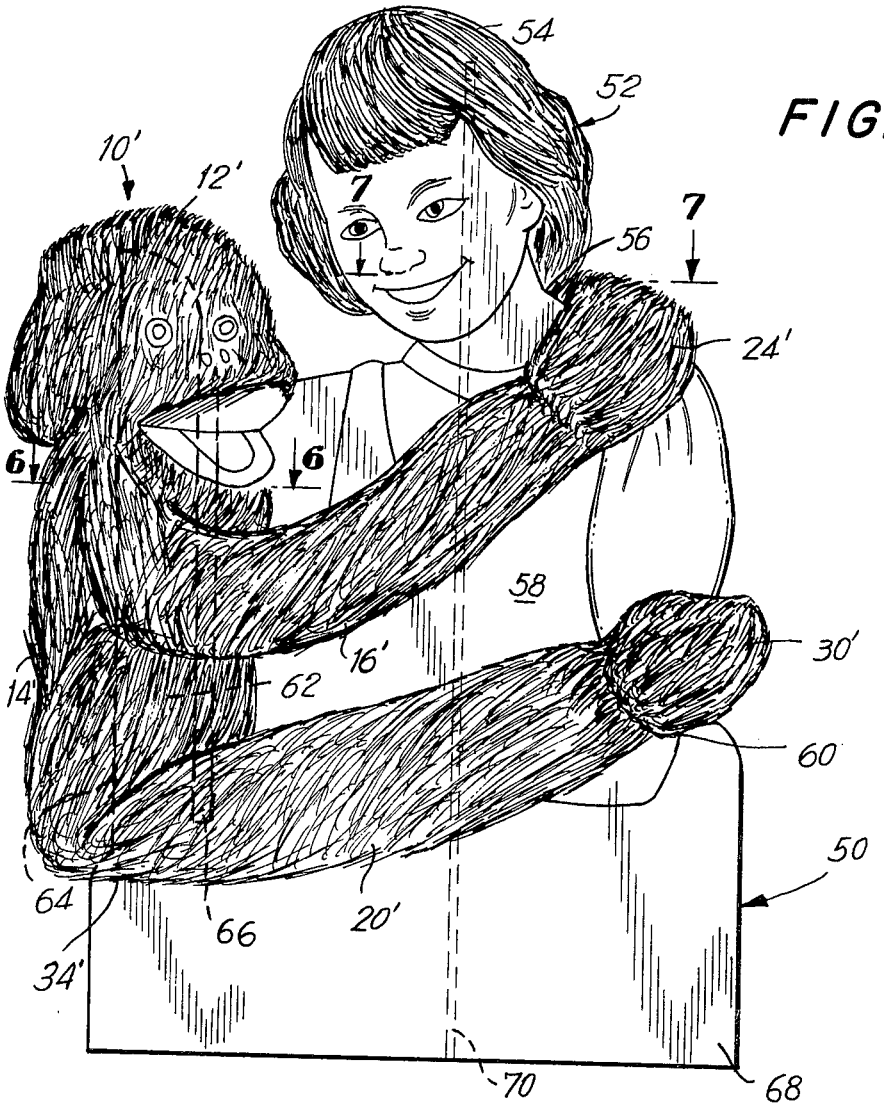
FIG. 5 is a different toy puppet supported on a display stand in accordance with this invention.

Referring now to the drawings, a human torso-supported puppet is shown in FIG. 1, and a display-supported puppet is shown in FIG. 5. The puppet in FIG. 1 resembles a whimsical frog-like animal, whereas the puppet in FIG. 5 resembles a whimsical monkey-like animal. It will be expressly understood that the present invention is not intended to be limited to such animal figures, because there is virtually an infinite variety of other figures that could have been selected. For example, the puppet figure can be designed to have any animal, person, fish, cartoon character, movie character, science fiction character or like configuration. The description provided below has been limited to frog- and monkey-like animals merely for ease of explanation.

Turning now to FIG. 1, reference numeral 10 identifies a fancifully-arranged frog-like animal toy puppet figure. The frog puppet figure 10 has a puppet head 12 having a whimsical expression; a puppet body 14 connected to the head 12; a pair of upper puppet limbs or arms 16,18 connected to the puppet body 14 generally adjacent the head 12 and extending outwardly away from the body 14; and a pair of lower puppet limbs or legs 20,22 connected to the puppet body 14 remotely from the head 12 and extending outwardly away from the body 14.

The frog puppet figure 10 is made of a soft manipulatable material, such as cotton cloth material, whose exterior surface is substantially covered by a soft plush material to simulate animal fur. The puppet arms 16,18 and legs 20,22 are each preferably sewn to opposite sides of the body 14. The puppet head is likewise sewn on the top of the body 14.

At the end of each puppet arm is provided a puppet hand 24 or 26 (see FIG. 2) which is covered with a differently-colored plush material. The puppet hands are sewn to the free outer end regions of the puppet arms. Similarly, at the end region of each puppet leg, is provided a puppet foot 28 or 30 (see FIG. 4) which is covered with a differently-colored plush material. The puppet feet are sewn to the free outer end regions of the puppet legs.

Figure 3:
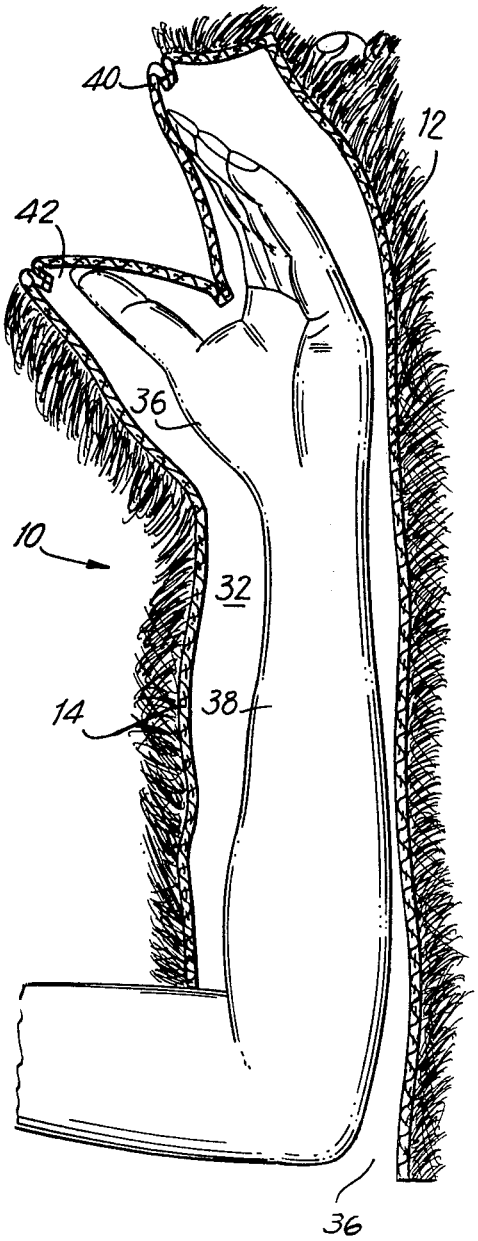
FIG. 3 is a sectional side view taken on line 3—3 of FIG. 1.

As best shown in FIG. 3, the puppet head 12 and body 14 are hollow, thereby defining an interior cavity 32 within the puppet figure. The cavity 32 has an access opening 34 located in the rear tail end region of the puppet animal. The access opening 34 and the cavity 32 are dimensioned to readily permit free insertion of the manipulator's hand and forearm therethrough and therein. The puppet figure 10 is dimensioned such that the manipulator's hand 36 can fit, with clearance, within the hollow puppet head 12, and at least the major portion of the manipulator's forearm 38 can fit, with clearance, within the hollow puppet body 14 along the spine of the puppet. The manipulator's fingers are preferably inserted in upper and lower puppet mouth pocket portions 40,42 on the head 12 to permit the simulation of mouth movement.

It will be noted that the overall dimensions of the puppet head 12 is larger than the average size of the human hand. The extent to which the human forearm is inserted into the puppet depends on the length of the human forearm which, of course, depends upon whether the manipulator is an adult or a child. Nevertheless, the length of the puppet body is about the average size of the human forearm and is intended to extend over at least a major portion of the same.

As for the puppet arms, they are each dimensioned to extend from the puppet body to a point behind the manipulator's neck when the puppet is positioned in the region generally adjacent the manipulator's chest. Each arm extension measures approximately 15 inches in a preferred embodiment. As for the puppet legs, they are each dimensioned to extend from the puppet body to a point at either side or behind the manipulator's waist when the puppet is positioned in the region generally adjacent the manipulator's chest. In a preferred embodiment each leg extends for a distance which measures about 17 inches. The overall height of the puppet figure is about 29 inches such that it essentially extends over the manipulator's chest and presents a relatively large-scale and full-bodied appearance.

Figure 2:
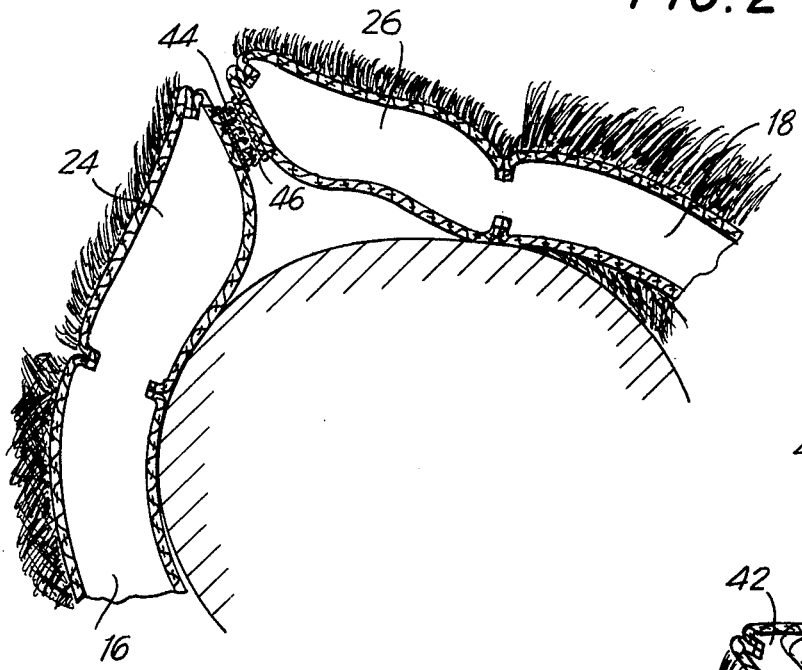
FIG. 2 is a sectional top view as taken on line 2—2 of FIG. 1.

In accordance with this invention, torso-supporting means are provided for supporting the puppet on the manipulator's person, preferably on his torso. As best shown in FIG. 2, the torso-supporting means includes neck-supporting means 44,46 on the puppet hands 24,26 and operative for securing the puppet arms 16,18 together to form an openable loop which encircles the manipulator's neck region. In a preferred embodiment, the neck-supporting means 44,46 constitutes a pair of quick connect-disconnect fasteners of the Velcro-type. The Velcro-type fasteners 44,46 are easily detachable to permit ready removal of the puppet arms from around the manipulator's neck, as well as being easily connectable to secure the puppet arms in place around the manipulator's neck. The Velcro-type fasteners engage each other with sufficient strength to easily support the weight of the puppet. It is also contemplated that the neck-supporting means be a closed loop which may be slipped over the manipulator's head.

Figure 4:
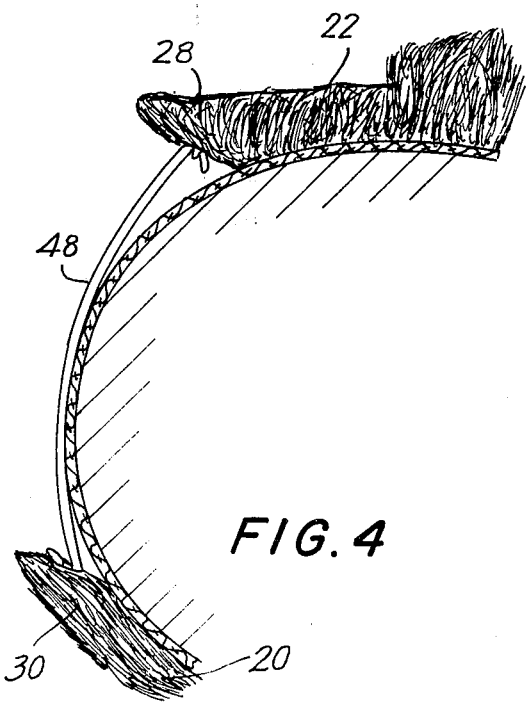
FIG. 4 is a sectional top view taken on line 4—4 of FIG. 1.

As best shown in FIG. 4, the torso-supporting means also includes waist-supporting means 48 on the puppet feet 28,30 and operative for securing the puppet legs 20,22 together to form a closed loop which encircles the manipulator's waist region. In a preferred embodiment, the waist-supporting means constitutes an elongated expandable member 48, such as an elastic rubberband, whose opposite ends are permanently connected to the puppet feet 28,30. The elastic band 48 is adjustable in length, i.e. it either expands or contracts as required, in order to adjust the distance between the puppet legs 20,22 to accommodate differently-sized manipulators' waist regions. It is also contemplated that the waist-supporting means be an openable loop which may be strapped around the manipulator's waist.

In use, the closed loop formed by the puppet legs 20,22 and the band 48 is slipped over the manipulator's head and pulled down over the manipulator's shoulders until it is properly positioned around the midriff section of the manipulator's waist. Of course, the manipulator could equally as well step into the closed loop and pull the same up over his hips until it is properly positioned around the manipulator's waist. The puppet arms 16, 18 are then placed over the manipulator's shoulders and fastened behind the manipulator's neck by engaging the Velcro-type fasteners 44,46 with each other. As described above, the user then inserts his hand through the access opening 34 and thereby reaches up inside the puppet interior cavity until the hand is located within the puppet head 12 and the forearm is located substantially within the puppet body 14. The softness and flexibility of the puppet material permits the manipulator to manipulate the puppet as desired.

Turning now to FIG. 5. a puppet 10' is supported on a display support 50 in a manner which resembles the human torso-supported puppet 10 of FIG. 1. The puppet 10' has a monkey-like configuration although, as noted above, any shape could have been selected. The puppet 10' has a hollow puppet head 12'; a hollow puppet body 14'; a pair of puppet arms 16',18'; a pair of puppet legs 20',22'; a pair of puppet hands 24',26'; a pair of puppet feet 28', 30'; an interior cavity 32'; and an access opening 34'. All of the just-described puppet parts, as well as the neck-supporting means 44', 46' and the waist-supporting means 48', are all analogous in structure and function to the corresponding parts of the puppet 10, and hence, will not be repeated for the sake of brevity.

Figure 6:
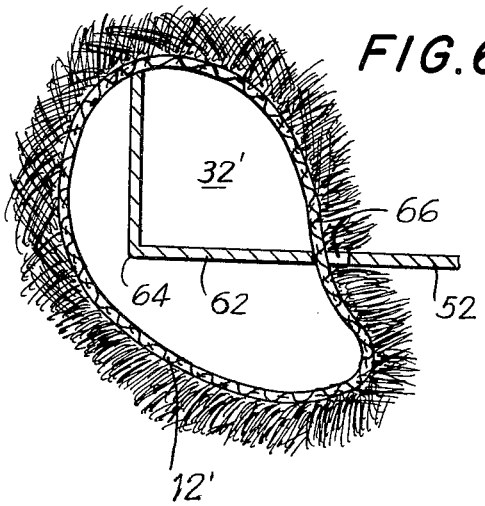
FIG. 6 is a sectional top view taken on line 6—6 of FIG. 5.

The display support 50 includes an upright humanoid-like portion 52 which resembles the upper part of a human being. For example, the humanoid-like portion 52 has a head-like display portion 54; a neck-like display portion 56; an upper torso display portion 58; and a waist-like display portion 60. The display support 50 also includes an upright arm support portion 62 which resembles the upraised human forearm. The arm support portion 62 is bendable to an L-shaped configuration (see FIG. 6) along the bend-line 64.

Figure 7:
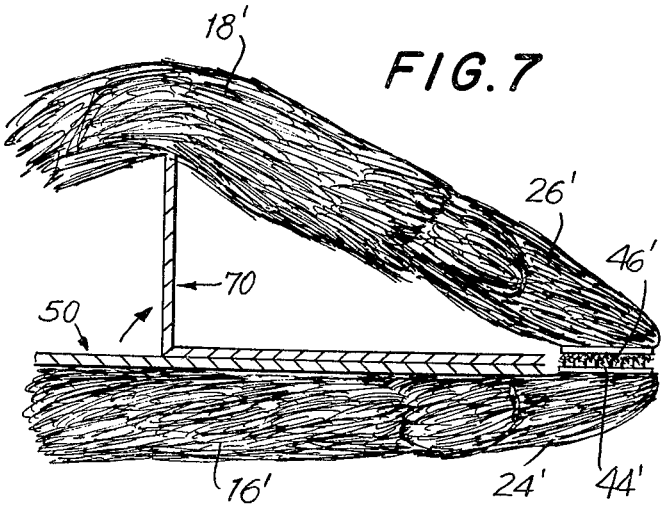
FIG. 7 is a sectional top view taken on line 7—7 of FIG. 5.

Humanoid-like portion 52 is located adjacent to, and spaced apart from, the arm support portion 62, thereby defining an upright vertically-extending slot 66. Below the slot 66, a transversely-extending base support portion 68 interconnects and supports the humanoid-like portion 52 and the arm support portion 62. A rear flap 70 (see FIG. 7) is mounted for swinging movement on the rear of the display support 50 to support the same on any mounting surface, such as a store counter-top.

In use, the provision of the slot 66 permits the arm support portion 62 to be freely inserted, with clearance, through the rear access opening 34' and into the interior cavity 32' of the puppet 10'. The arm support portion 62 is pre-bent into the L-shaped configuration of FIG. 6 in order to support the puppet 10' in all three dimensions, thereby imparting a more realistic appearance to the display. In a manner analogous to that described above, the puppet legs 28', 30' are mounted around the waist-like display portion 60, and the puppet arms 16',18' are connected behind the neck-like display portion 56. The puppet 10' appears to be supported on the torso-like display portion 58.

The display support 50 is self-supporting when the rear flap 70 is moved from a storage position in which it lies co-planar with the display support 50, to a display position in which it lies normally of the display support 50. The self-standing display support 50 makes for a very attractive and attention-getting display which simulates the human torso-supported puppet.

It will be understood that each of the elements described above, or two or more together, may also find a useful application in other types of constructions differing from the types described above.

While the invention has been illustrated and described as embodied in a torso- and display-supportable puppet, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A puppet supportable on a manipulator's torso, comprising:

(a) a puppet figure having a puppet head and a puppet body connected to the puppet head, said puppet figure bounding an interior cavity which is located within the puppet head and body, and which is dimensioned to permit free insertion of the manipulator's hand and at least a major portion of the manipulator's forearm therein, said puppet figure also having a pair of soft, upper puppet limbs connected to and extending from the puppet body for a distance sufficient for extending behind the manipulator's neck region when the puppet is positioned in embracing relation generally adjacent the manipulator's chest, and further having a pair of soft, lower puppet limbs connected to and extending from the puppet body for a distance sufficient for extending behind the manipulator's waist region when the puppet is positioned in embracing relation generally adjacent the manipulator's chest; and (b) torso-supporting means on the puppet figure, for supporting the same on the manipulator's torso, said torso-supporting means including neck-supporting means for securing the upper portion limbs around the manipulator's neck region, and waist-supporting means for securing the lower puppet limbs around the manipulator's waist region, whereby the torso-supported puppet is manipulatable by both the manipulator's hand and forearm while mounted in embracing relation on the manipulator's torso.

2. The puppet as defined in claim 1, wherein the upper puppet limbs are dimensioned to at least encircle the manipulator's neck region; and wherein the neck-supporting means includes detachable fastening means on the upper puppet limbs, for detachably connecting the upper puppet limbs to each other behind the manipulator's neck region.

3. The puppet as defined in claim 1, wherein the lower puppet limbs are dimensioned to at least partially encircle the manipulator's waist region; and wherein the waist-supporting means includes an adjustable fastening means on the lower puppet limbs, for adjustably interconnecting the lower puppet limbs to each other behind the manipulator's waist region.

4. The puppet as defined in claim 3, wherein the adjustable fastening means includes expandable means connected between the lower puppet limbs, for adjusting the distance between the lower puppet limbs to accommodate differently-sized manipulators' waist regions.

5. The puppet as defined in claim 1, wherein the puppet figure has a hollow puppet head in which the manipulator's hand is freely insertable, and wherein the puppet figure has a hollow puppet body in which at least the major portion of the manipulator's forearm is freely insertable, whereby full manipulation of both the puppet head and puppet body is permitted while the puppet is supported on the manipulator's torso.

6. The puppet as defined in claim 1, wherein the puppet figure has an animal-like configuration and has an exterior soft covering which is at least partially covered with plush material.

7. A display-supportable puppet, comprising:

(a) an upright display support mountable on a support surface, said display support having a humanoid-like portion generally resembling the upper portion of a human, and an upright arm support portion generally resembling the upraised human forearm, said humanoid-like portion including a neck-like portion and a waist-like portion, said upright arm support portion being located closely adjacent to, and spaced apart from, the humanoid-like portion;

(b) a puppet figure having a puppet head and a puppet body connected to the puppet head, said puppet figure bounding an interior cavity which is located within the puppet head and body, and which is dimensioned to permit free insertion of the upright arm support portion therein, said puppet figure also having a pair of soft, upper puppet limbs connected to and extending from the puppet body for a distance sufficient for extending behind the neck-line display portion when the puppet is supported in embracing relation on the display support, and further having a pair of soft, lower puppet limbs connected to and extending from the puppet body for a distance sufficient for extending behind the waist-like display portion when the puppet is supported in embracing relation on the display support; and (c) display-supporting means on the puppet figure for supporting the same on the display support, said display-supporting means including neck-supporting means for securing the upper puppet limbs around the neck-like display portion, and waist-supporting means for supporting the lower puppet limbs around the waist-like display portion, whereby the display-supported puppet is displayed in embracing relation in a manner resembling a human torso-supported puppet.

8. The display-supportable puppet as defined in claim 7, wherein the upright arm support portion bounds an upright slot with the humanoid-like portion; and wherein the display support includes a base portion extending between the humanoid-like portion and the upright arm support portion below the slot.

9. The display-supportable puppet as defined in claim 7, wherein the upright arm support portion is bendable along an upright bend-line to support the puppet in three dimensions.

10. A puppet supportable on a manipulator's torso, comprising:

(a) a puppet figure having a puppet head and a puppet body connected to the puppet head, said puppet figure bounding an interior cavity which is located within the puppet head and body, and which is dimensioned to permit free insertion of the manipulator's hand and at least a major portion of the manipulator's forearm therein, said puppet having a pair of upper puppet limbs connected to and extending from the puppet body for a distance sufficient for extending behind the manipulator's neck region when the puppet is positioned in embracing relation generally adjacent the manipulator's chest, and also having a pair of lower puppet limbs connected to and extending from the puppet body for a distance sufficient for extending behind the manipulator's waist region when the puppet is positioned in embracing relation generally adjacent the manipulator's chest; and (b) torso-supporting means on the puppet figure, for supporting the same on the manipulator's torso, said torso-supporting means including neck-supporting means for detachably fastening the upper puppet limbs to each other behind the manipulator's neck region, and waist-supporting means for fastening the lower puppet limbs to each other behind the manipulator's waist region.

11. The puppet as defined in claim 10, wherein the neck-supporting means includes a quick connect-disconnect fastener at each end region of the upper puppet limbs; and wherein the waist-supporting means includes an elongated expandable member at each end region of the lower puppet limbs, said expandable member being expandable to accommodate differently-sized manipulators' waist regions.

12. A display-supportable puppet, comprising:

(a) an upright display support mountable on a support surface, said display support having a humanoid-like portion generally resembling the upper portion of a human, and an upright arm support portion generally resembling the upraised human forearm, said humanoid-like portion including a neck-like portion and a waist-like portion, said upright arm support portion being located closely adjacent to, and spaced apart from, the humanoid-like portion;

(b) a puppet figure having a puppet head and a puppet body connected to the puppet head, said puppet figure bounding an interior cavity which is located within the puppet head and body, and which is dimensioned to permit free insertion of the upright arm support portion therein, said puppet figure also having a pair of upper puppet limbs each connected to and extending from the puppet body for a distance sufficient for extending behind the neck-like display portion in embracing relation when the puppet is supported on the display support, and further having a pair of lower puppet limbs each connected to and extending from the puppet body for a distance sufficient for extending behind the waist-like display portion in embracing relation when the puppet is supported on the display support; and (c) display-supporting means on the puppet figure for supporting the same on the display support, said display-supporting means including neck-supporting means for detachably fastening the upper puppet limbs to each other behind the neck-like display portion, and waist-supporting means for fastening the lower puppet limbs to each other behind the waist-like display portion, whereby the display-supported puppet is displayed in embracing relation in a manner resembling a human torso-supported puppet.

13. The display-supportable puppet as defined in claim 12, wherein the neck-supporting means includes a quick connect-disconnect fastener at each end region of the upper puppet limbs; and wherein the waist-supporting means includes an elongated expandable member at each end region of the lower puppet limbs.

* * * * *